US007663316B2

(12) United States Patent
Min

(10) Patent No.: US 7,663,316 B2
(45) **Date of Patent: *Feb. 16, 2010**

(54) PLASMA DISPLAY PANEL HAVING BARRIER RIBS WITH BLACK MATRIX

(75) Inventor: Woong Kee Min, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 305 days.

This patent is subject to a terminal disclaimer.

(21) Appl. No.: 11/690,447

(22) Filed: Mar. 23, 2007

(65) Prior Publication Data

US 2007/0159102 A1 Jul. 12, 2007

Related U.S. Application Data

(63) Continuation-in-part of application No. 11/092,735, filed on Mar. 28, 2005, now Pat. No. 7,224,120.

(30) Foreign Application Priority Data

Mar. 30, 2004 (KR) ..... 10-2004-0021696
Mar. 30, 2004 (KR) ..... 10-2004-0021700

(51) Int. Cl.
*H01J 17/49* (2006.01)

(52) U.S. Cl. ..... 313/582; 313/292

(58) Field of Classification Search ..... 313/585
See application file for complete search history.

(56) References Cited

U.S. PATENT DOCUMENTS 5,541,479 A 7/1996 Nagakubo
6,577,062 B2 * 6/2003 Itokawa et al. ..... 313/582
6,611,099 B1 8/2003 Murata et al.
2002/0021090 A1 2/2002 Sano et al.
2002/0101151 A1 8/2002 Choi et al.
2004/0263077 A1 12/2004 Kao et al.
2005/0046350 A1 3/2005 Su et al.
2006/0170354 A1 * 8/2006 Hwang ..... 313/582

FOREIGN PATENT DOCUMENTS

| | | |
|---|---|---|
| CN | 1306270 | 8/2001 |
| EP | 1119015 | 9/1999 |
| EP | 1119015 | 7/2001 |
| EP | 1187166 | 3/2002 |
| JP | 05258682 | 10/1993 |
| KR | 1020010003713 | 1/2001 |

OTHER PUBLICATIONS

WO 01/41178 A1, "Structure of a Barrier in a Plasma Display Panel", Jun. 7, 2001, Orion Electric Co., Ltd.*

* cited by examiner

*Primary Examiner*—Nimeshkumar D. Patel
*Assistant Examiner*—Jacob Stern
(74) *Attorney, Agent, or Firm*—Lee, Hong, Degerman, Kang & Waimey

(57) ABSTRACT

A plasma display panel and a manufacture method thereof are disclosed. The plasma display panel having a plurality of discharge pixels, the panel includes a first barrier rib, with a first width, formed to function as a boundary between the discharge pixels, a second barrier rib, with a second width, formed to function as a boundary between the discharge pixels, wherein the second width is more than the first width, and a black matrix formed over the second barrier rib.

14 Claims, 12 Drawing Sheets

PLASMA DISPLAY PANEL HAVING BARRIER RIBS WITH BLACK MATRIX

CROSS-REFERENCE TO RELATED APPLICATIONS

Pursuant to 35 U.S.C. §120, this application is a continuation-in-part of the U.S. application Ser. No. 11/092,735, filed on Mar. 28, 2005, now U.S. Pat. No. 7,224,120, which claims priority to KR Appln. Ser. Nos. 10-2004-0021696 and 10-2004-0021700, both filed on Mar. 30, 2004, the contents of each of which are hereby incorporated by reference herein in their entirety.

BACKGROUND

1. Field

This document relates to a plasma display panel and a manufacture method thereof.

2. Background—Description of Related Art

In general, plasma display panel (Hereinafter, referred to as "PDP") includes a front substrate and a rear substrate formed of soda-lime glass, and a barrier rib defining one unit cell between the front substrate and the rear substrate. When inert gas such as He—Xe and He—Ne is discharged due to a high frequency voltage in each unit cell, vacuum ultraviolet rays are generated and phosphor is excited between the barrier ribs, thereby displaying an image.

FIG. 1 is a schematic perspective view illustrating a structure of a conventional plasma display panel.

As shown in FIG. 1, a plasma display panel (PDP) 100 includes a front substrate 10 and a rear substrate 20, which are spaced apart and engaged in parallel with each other. The front substrate 10 is a display surface on which the image is displayed. The rear substrate 20 is a rear surface. The front substrate 10 is formed at a lower side of the PDP. The front substrate 10 includes a pair of sustain electrodes 11 for sustaining light emission using a mutual discharge in one pixel. The sustain electrodes 11 are comprised of a transparent electrode 11*a* formed of indium-tin-oxide (ITO) and a bus electrode 11*b* formed of metal. The sustain electrodes 11 are covered with a dielectric layer 12*a*, which limits a discharge current and insulates the sustain electrodes. A passivation layer 13 is formed of oxide magnesium (MgO) on the dielectric layer 12*a* to facilitate a discharge. The rear substrate 20 includes stripe-type (or well-type) barrier ribs 21 and a plurality of address electrodes 22. The stripe-type (or well-type) barrier ribs 21 are arranged in parallel with one another to form a plurality of discharge spaces, that is, a plurality of cells. The plurality of address electrodes 22 are arranged in parallel with the barrier ribs 21 to perform an address discharge and generate vacuum ultraviolet rays at their intersection with the sustain electrodes 11. A dielectric layer 12*b* is formed on the address electrodes 22. Red (R), green (G), blue (B) phosphors 23 are coated on the dielectric layer 12*b* to emit a visible ray, thereby displaying the image in the address discharge. A method for expressing a gray level in the above constructed PDP is illustrated in FIG. 2.

FIG. 2 is a view illustrating a conventional method for expressing the gray level in the plasma display panel.

As shown in FIG. 2, the gray level is expressed by dividing one frame into several sub-fields each having a different number of light emission times. Each of the sub-fields is divided into a reset period for uniformly generating the discharge, an address period for selecting the discharge cell, and a sustain period for expressing the gray level depending on the number of discharge times. For example, when the image is displayed in 256 gray levels, a frame period (16.6 ms) corresponding to 1/60 second is divided into eight sub-fields (SF1 to SF8). Each of eight sub-fields is again divided into the reset period, the address period and the sustain period. The reset period and the address period are the same at each sub-field. The address discharge is generated by a voltage difference between the address electrode (data electrode) and the transparent electrode (scan electrode) to select the discharge cell. The sustain period is increased in a ratio of $2^n$ (n=0, 1, 2, 3, 4, 5, 6, 7) at each sub-field.

In general, in the PDP, the unit pixel is constituted of three kinds of sub-pixels emitting R, G, B lights. Each of the sub-pixels controls an amount of emitted light depending on the number of the sustain pulses, and visually juxtaposes and mixes the controlled lights, thereby expressing the color and the gray level.

FIGS. 3A through 3D are views illustrating various discharge cell structures in the conventional plasma display panel. FIG. 3A illustrates the discharge cell structure having a stripe-type barrier rib, FIG. 3B illustrates the discharge cell structure having a well-type barrier rib, FIG. 3C illustrates the discharge cell structure having a delta-type barrier rib, and FIG. 3D illustrates the discharge cell structure having a honey-type barrier rib.

As shown in FIGS. 3A through 3D, in sub-pixels 101*a*, 101*b* and 101*c* of the conventional PDP having the above discharge cell structure, a barrier rib 21 separates phosphors expressing each R, G, B color. The sub-pixels 101*a*, 101*b* and 101*c* constitute a unit pixel 101 with the barrier rib 21 functioning as a boundary. The unit pixel is arranged to form a predetermined shape with an adjacent unit pixel using the barrier rib 21 functioning as the boundary, to display the image.

In the PDP having the discharge cell structure, the barrier rib functions to prevent electrical and optical crosstalk between the sub-pixels or the unit pixels. The barrier rib is the most important element in controlling a display quality and a light emission efficiency of the PDP. In the conventional PDP, the barrier rib partitioning the unit pixel has the same width as the barrier rib functioning as the boundary between the R, G, B sub-pixels constituting the unit pixel. In the PDP where each unit pixel emits light and the emitted light is mixed and displayed, there is a drawback in that a color mixture characteristic depending on a color of the adjacent unit pixel is not good. In other words, since the barrier rib formed between the sub-pixels has the same width as the barrier rib formed between the unit pixels, when the PDP is driven, the color mixture characteristic between an inherent color of the unit pixel and the color of the adjacent unit pixel is deteriorated.

In the conventional PDP having the above discharge cell structure, a black matrix having a low reflectance is formed at the front substrate to separate the colors and decrease a reflectance between upper and lower unit pixels, thereby improving a contrast characteristic.

FIGS. 4A and 4B are views illustrating black matrix structures disposed at the front substrate in the conventional PDP having the stripe-type discharge cell structure or the well-type discharge cell structure.

Referring to FIGS. 4A and 4B, in the front substrate 10, a black matrix 13*a* is formed only in a traverse direction of the unit pixel 101. Such a black matrix structure has a good contrast characteristic due to color separation and reflectance reduction between the unit pixels 101 formed at upper and lower sides on the basis of the black matrix 13*a*. However, it is not so in left and right unit pixels. Accordingly, in the conventional rear substrate, the barrier rib 21 partitioning the unit pixels or the sub-pixels is formed of black-color material having the low reflectance to improve the contrast characteristic. However, such a black matrix structure has a drawback in that since the transparent front substrate is provided at a predetermined thickness between an upper end of the barrier rib and the exterior, the emitted light is not fully blocked between the unit pixels, thereby deteriorating the contrast characteristic.

SUMMARY

Accordingly, an object of the present invention is to solve at least the problems and disadvantages of the background art.

An object of the present invention is to provide a plasma display panel and a manufacture method thereof in which a barrier rib partitioning a unit pixel is deformed in structure, thereby improving a visual color mixture, and concurrently the barrier rib is improved in reflectance and a black matrix is improved in structure, thereby improving a contrast characteristic.

To achieve these and other advantages and in accordance with the purpose of the present invention, as embodied and broadly described, there is provided a plasma display panel for displaying an image, the panel including: a first barrier rib formed to function as a boundary between one sub-pixel and another sub-pixel, for partitioning a plurality of sub-pixels, and a second barrier rib formed to function as a boundary between one unit pixel constituted of the plurality of sub-pixels and an adjacent unit pixel, partitioning the unit pixels, wherein the second barrier rib has a greater width than the first barrier rib.

A black-color material layer is formed on the first barrier rib and the second barrier rib.

In another aspect of the present invention, there is provided a plasma display panel for displaying an image, the panel including: a first barrier rib formed to function as a boundary between one sub-pixel and another sub-pixel, for partitioning a plurality of sub-pixels, a second barrier rib formed to function as a boundary between one unit pixel constituted of the plurality of sub-pixels and an adjacent unit pixel, partitioning the unit pixels, a first black matrix formed in a vertical direction of the first barrier rib and the second barrier rib, and a second black matrix formed in an extension direction of the second barrier rib, wherein the second barrier rib has a greater width than the first barrier rib.

The second black matrix has a predetermined gap partitioning the unit pixel at its center portion.

The first barrier rib and the second barrier rib all have white-color materials.

In a further aspect of the present invention, there is provided a plasma display panel for displaying an image, the panel including: a first barrier rib formed to function as a boundary between one sub-pixel and another sub-pixel, for partitioning a plurality of sub-pixels, and a second barrier rib formed to function as a boundary between one unit pixel constituted of the plurality of sub-pixels and an adjacent unit pixel, partitioning the unit pixels, wherein the first barrier rib and the second barrier rib are all formed of black-color material, and wherein the second barrier rib has a greater width than the first barrier rib.

In the plasma display panel, the first barrier rib and the second barrier rib form at least one of stripe-type, well-type, delta-type, and honey-type discharge cell structures.

In a further another aspect of the present invention, the present plasma display panel comprises a plurality of unit pixels comprising a first sub-pixel, a second sub-pixel, and a third sub-pixel, wherein the first sub-pixel, the second sub-pixel, and the third sub-pixel correspond to a red color sub-pixel, a green color sub-pixel, and a blue color sub-pixel, respectively, a first barrier rib formed to function as a boundary between the sub-pixels and formed in a longitudinal direction of the sub-pixels, a second barrier rib formed to function as a boundary between the plurality of unit pixels and formed in a longitudinal direction of the first barrier rib, wherein the second barrier rib has a width that is more than a width of the first barrier rib, and a longitudinal black matrix formed over the second barrier rib.

BRIEF DESCRIPTION OF THE DRAWINGS

The invention will be described in detail with reference to the following drawings in which like numerals refer to like elements.

DETAILED DESCRIPTION

Embodiments will be described in a more detailed manner with reference to the drawings.

First Embodiment

Figure 1:
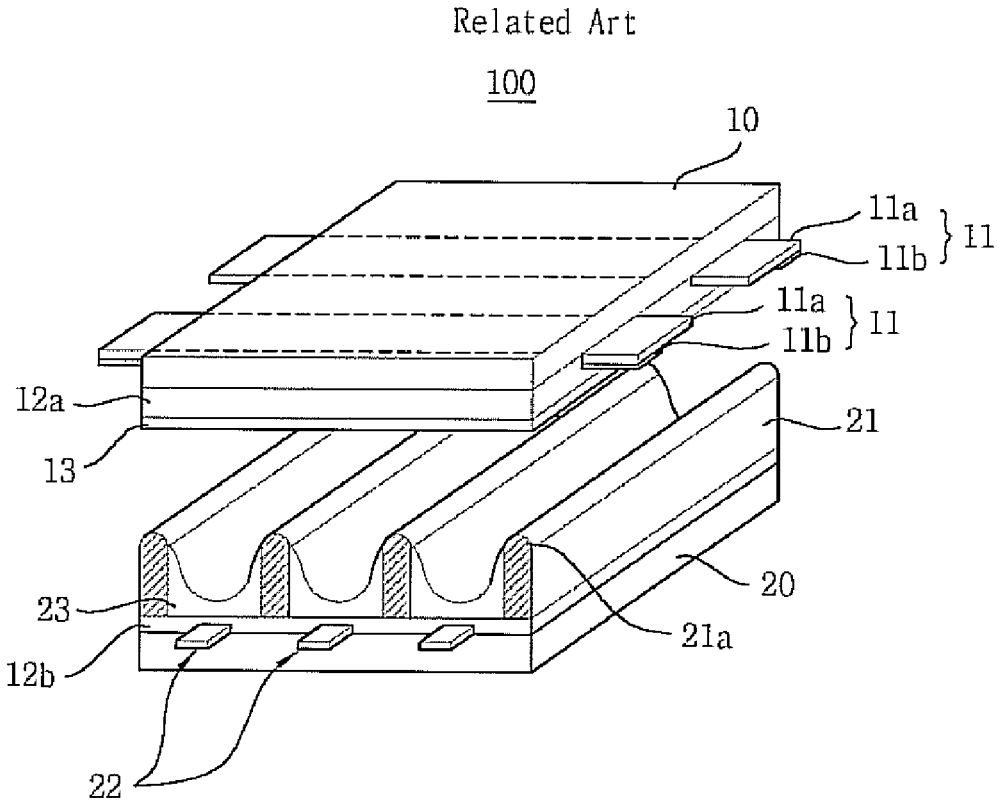
FIG. 1 is a schematic perspective view illustrating a structure of a conventional plasma display panel.
Figure 2:
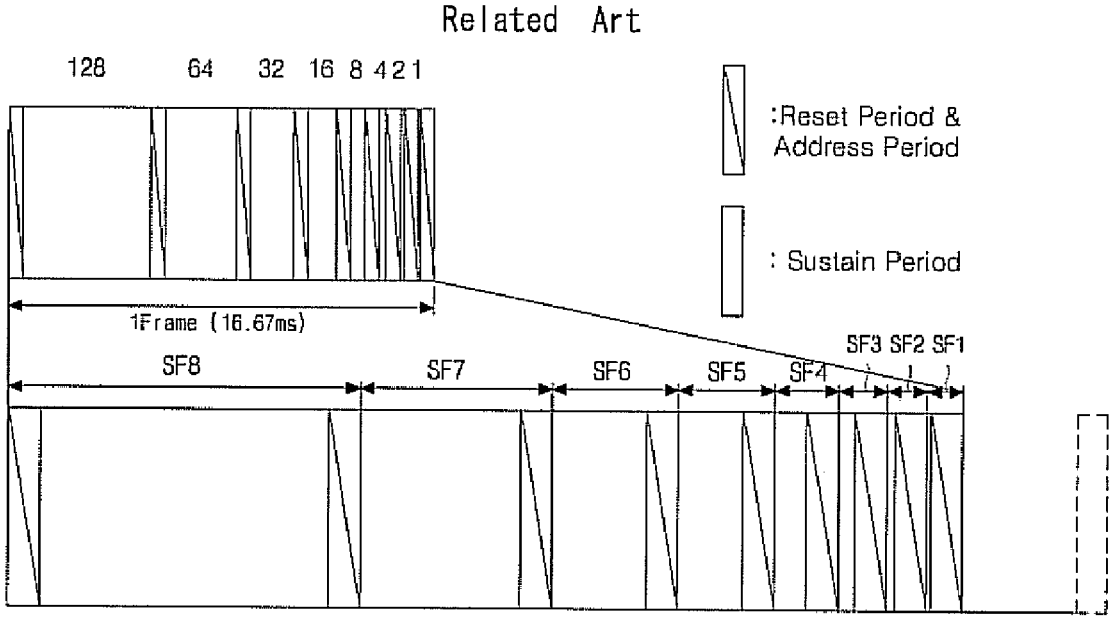
FIG. 2 is a view illustrating a conventional method for expressing a gray level in a plasma display panel.
Figure 3A:
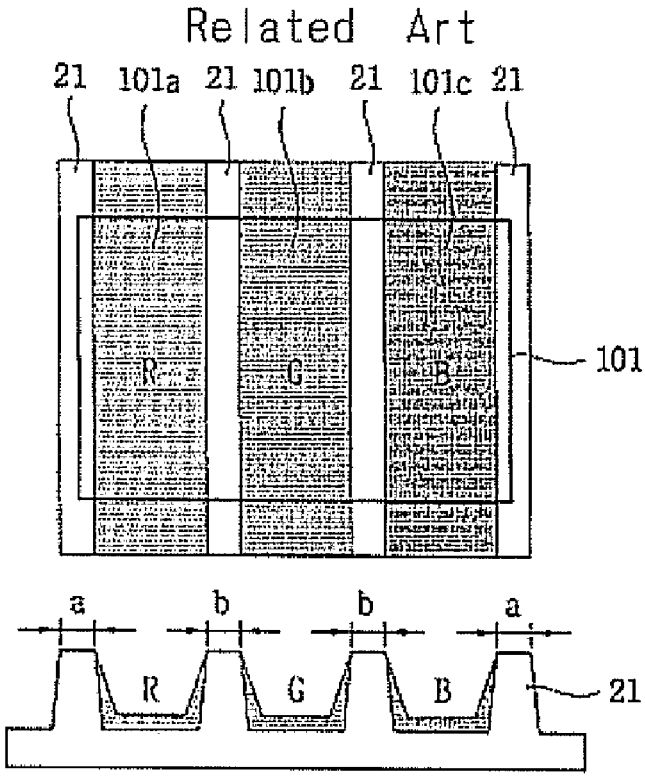
FIGS. 3A through 3D are views illustrating various discharge cell structures in a conventional plasma display panel.
Figure 3B:
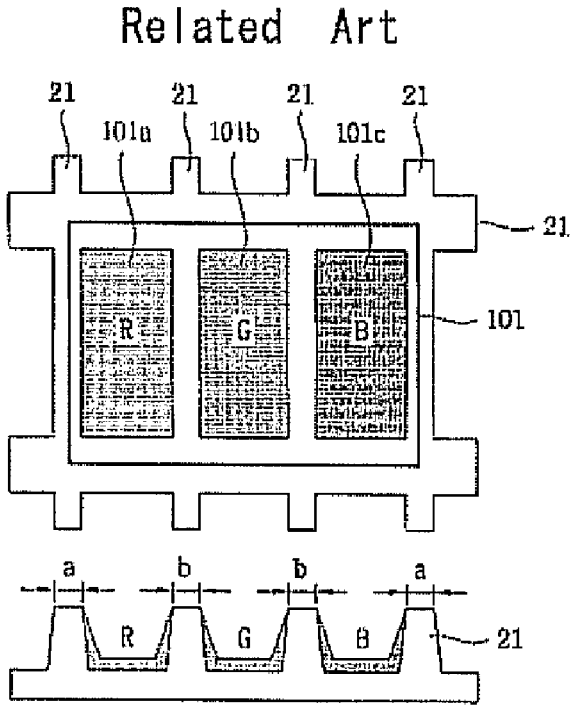
Figure 3C:
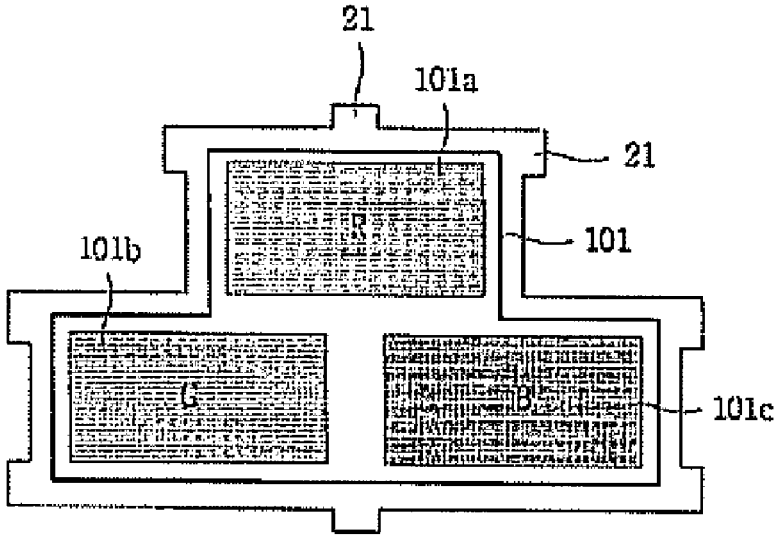
Fig. 3c Related Art
Figure 3D:
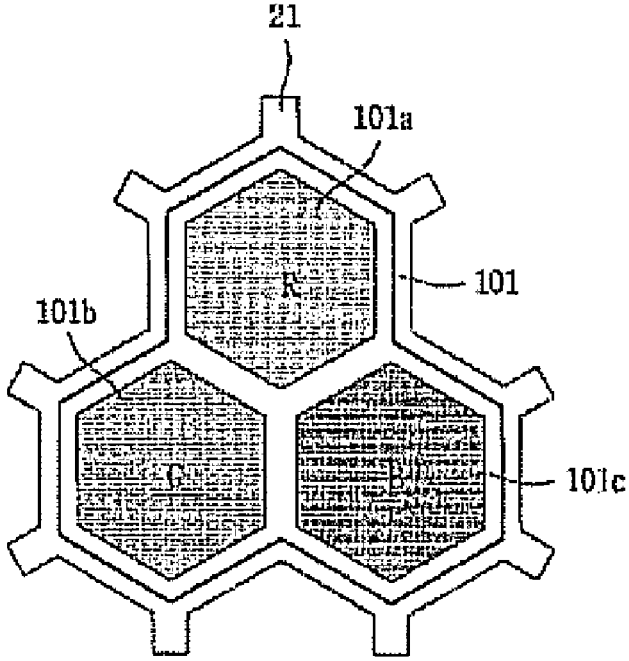
Fig. 3d Related Art
Figure 4A:
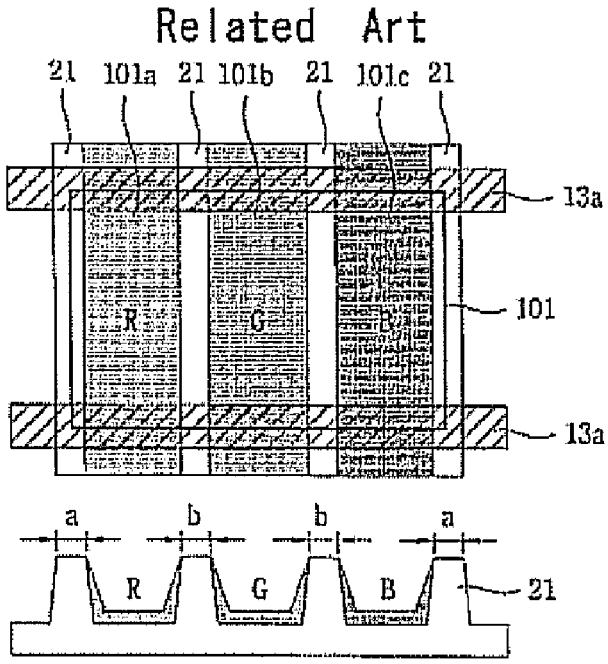
FIGS. 4A and 4B are views illustrating black matrix structures disposed at front substrates in a conventional plasma display panel having a stripe-type discharge cell structure or a well-type discharge cell structure.
Figure 4B:
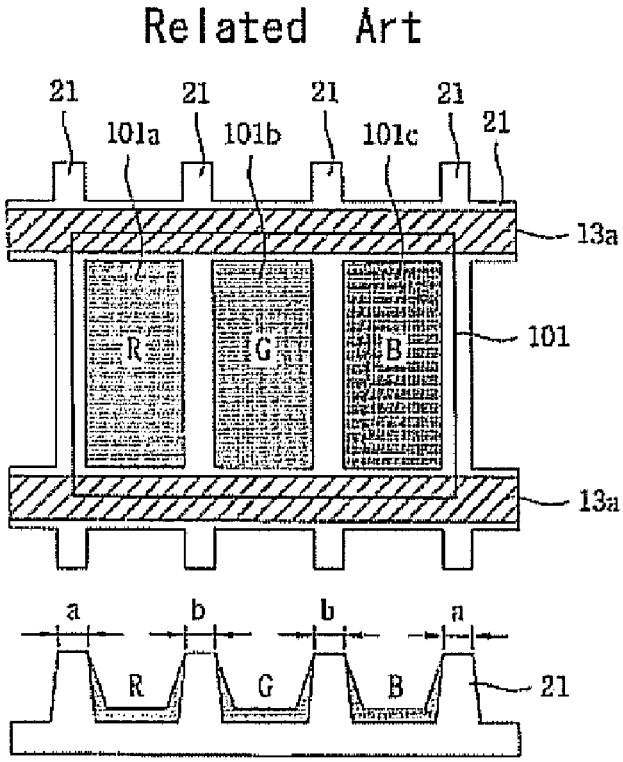
Figure 5A:
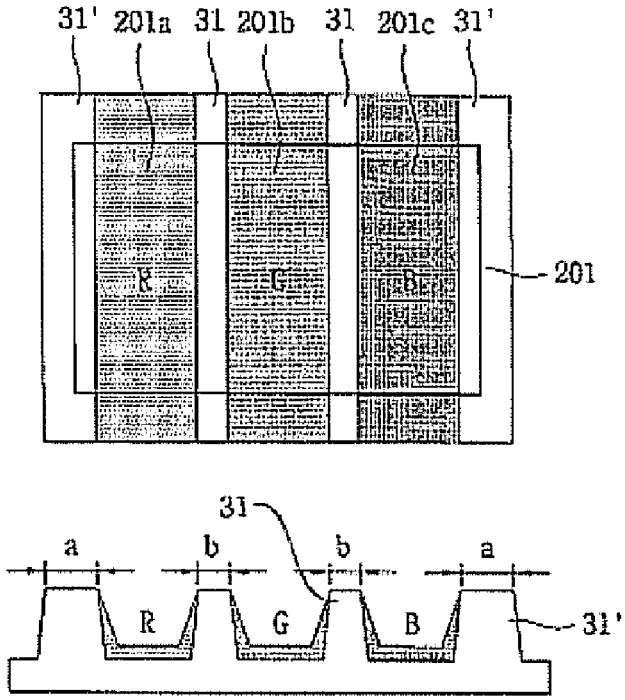
FIGS. 5A and 5B are views illustrating barrier rib structures of discharge cell structures in a plasma display panel according to a first embodiment of the present invention.
Figure 5B:
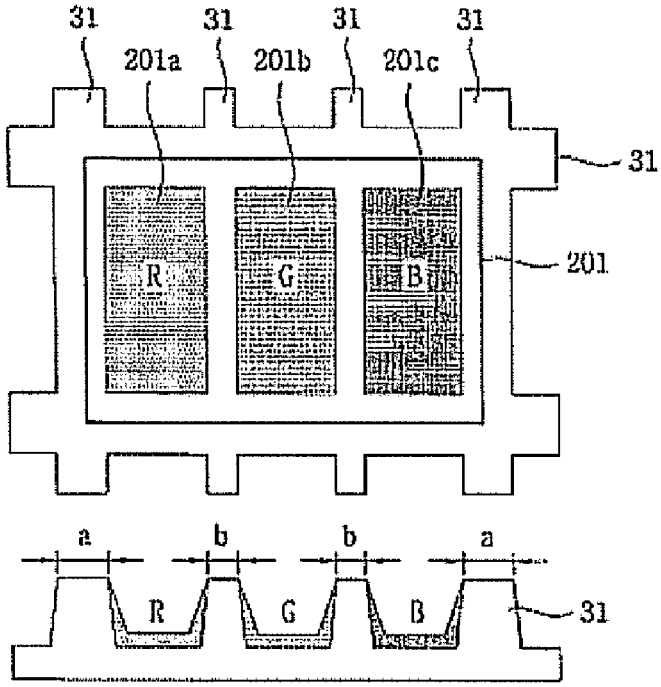

FIGS. 5A and 5B are views illustrating barrier rib structures of discharge cell structures in a plasma display panel according to a first embodiment of the present invention. In other words, FIG. 5A illustrates the barrier rib structure in a stripe-type discharge cell structure according to the present invention, and FIG. 5B illustrates the barrier rib structure in a well-type discharge cell structure according to the present invention.

As shown in FIGS. 5A and 5B, the inventive plasma display panel includes a first barrier rib 31 and a second barrier rib 31' each disposed at a rear substrate. The first barrier rib 31 partitions red (R), green (G) and blue (B) sub-pixels 201*a*, 201*b* and 201*c*. The second barrier rib 31' partitions a unit pixel 201, which is constituted of the R, G, B sub-pixels 201*a*, 201*b* and 201*c*, and an adjacent unit pixel. On the assumption that the first barrier rib 31 partitioning the R, G, B sub-pixels 201*a*, 201*b* and 201*c* has a width of "b" and the second barrier rib 31' partitioning the unit pixel 201 and the adjacent unit pixel has a width of "a", the width "a" is much greater than the width "b". In other words, the width "a" of the second barrier rib 31' functioning as a boundary between the unit pixel and the adjacent unit pixel is greater than the width "b" of the first barrier rib 31 functioning as a boundary between the sub-pixels. A black-color material layer is formed on the first barrier rib 31 and the second barrier rib 31'.

The inventive barrier rib can be manufactured using not only a sand blasting method but also any one of a screen printing method, an additive method and a photosensitive paste method. The inventive barrier rib is applicable not only to the stripe-type and well-type discharge cell structures of FIGS. 5A and 5B, but also to a delta-type or honey-type discharge cell structure.

As such, in the inventive plasma display panel having the barrier rib structure, a unit pixel color combined due to light emission of the R, G, B sub-pixels is more spaced apart from an adjacent unit pixel color, thereby improving a visual color mixture.

Second Embodiment

Figure 6A:
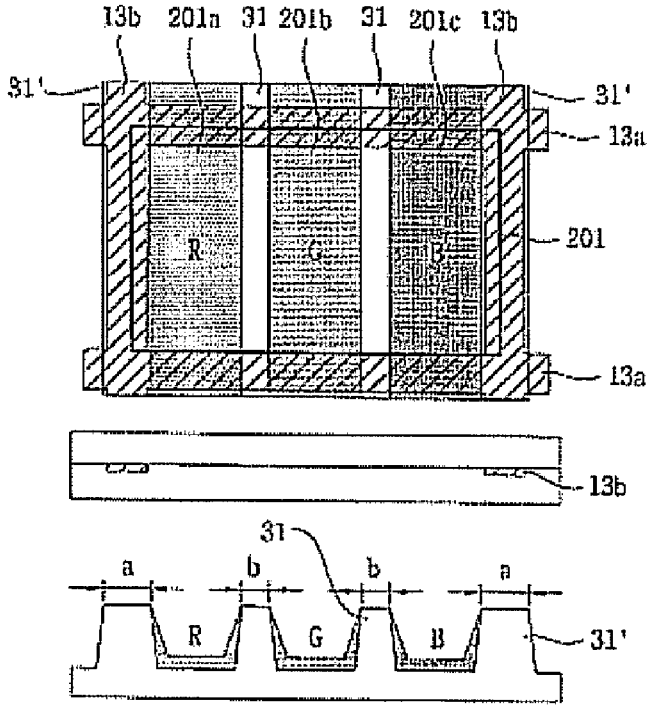
FIGS. 6A and 6B are views illustrating barrier rib structures and black matrix structures of discharge cell structures in a plasma display panel according to a second embodiment of the present invention.
Figure 6B:
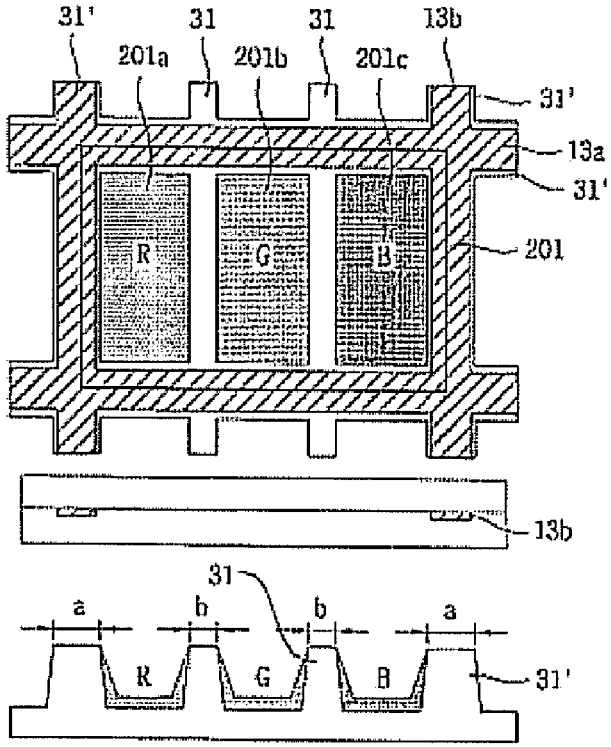

FIGS. 6A and 6B are views illustrating barrier rib structures and black matrix structures of discharge cell structures in a plasma display panel according to a second embodiment of the present invention. In other words, FIG. 6A illustrates the barrier rib structure and the black matrix structure in a stripe-type discharge cell structure, and FIG. 6B illustrates the barrier rib structure and the black matrix structure in a well-type discharge cell structure.

In FIGS. 6A and 6B, the inventive barrier rib structures are the same as those of the first embodiment and therefore, their descriptions are omitted. However, in the inventive plasma display panel, a black matrix having a predetermined pattern is formed at a front substrate. It is desirable that a barrier rib has a white-color material to compensate for luminance reduction caused by the black matrix of the front substrate in the PDP.

Like a conventional art, in the inventive plasma display panel having the stripe-type and well-type discharge cell structures, a first black matrix 13*a* is formed at the front substrate to be in a vertical direction of a first barrier rib 31 and a second barrier rib 31'. A second black matrix 13*b* is formed in an extension direction of the second barrier rib 31' partitioning unit pixels. In other words, the second black matrix 13*b* is extended from the second barrier rib 31' and formed on the front substrate. The second barrier rib 31' has a greater width than the first barrier rib 31 partitioning sub-pixels. In some cases, the black matrix can be formed in the extension direction of the first barrier rib 31 partitioning the sub-pixels. However, there is a drawback in that a luminance characteristic can be deteriorated, and there is a process difficulty in maintaining an alignment characteristic between the barrier rib of the rear substrate and the black matrix of the front substrate. Therefore, it is desirable that the black matrix is formed in the extension direction of the second barrier rib 31' partitioning the unit pixels 201.

The black matrix is formed of paste in a screen-printing method and the like. The paste employs a metallic compound such as chrome (Cr) or a nonmetallic compound. In the black matrix formed of metallic compound, reflectance can be decreased due to poor transparency, thereby improving the contrast characteristic. However, when a voltage is applied to a plurality of electrodes formed at the front substrate, a dielectric material covering the electrodes is broken down in dielectricity, thereby conducting the black matrix in a cell discharge. Accordingly, there is a drawback in that an erroneous cell discharge is caused in the PDP.

Figure 7A:
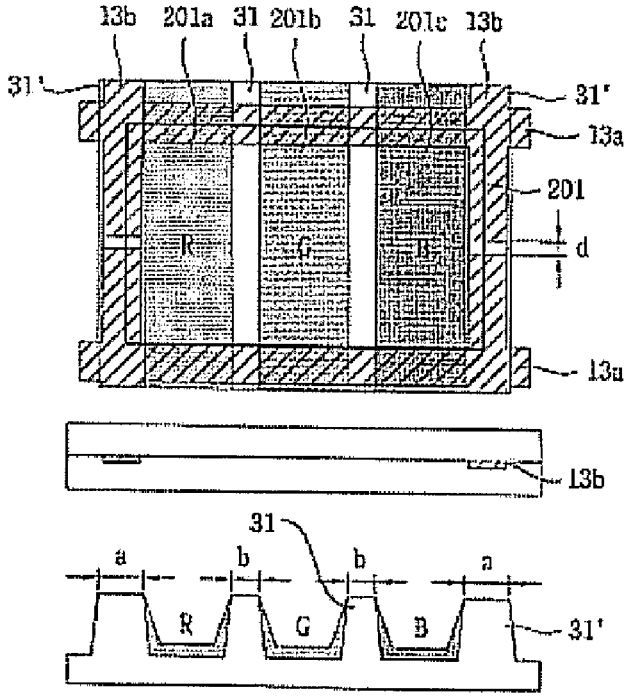
FIGS. 7A and 7B are views illustrating black matrix structures of discharge cell structures in a plasma display panel according to the present invention.
Figure 7B:
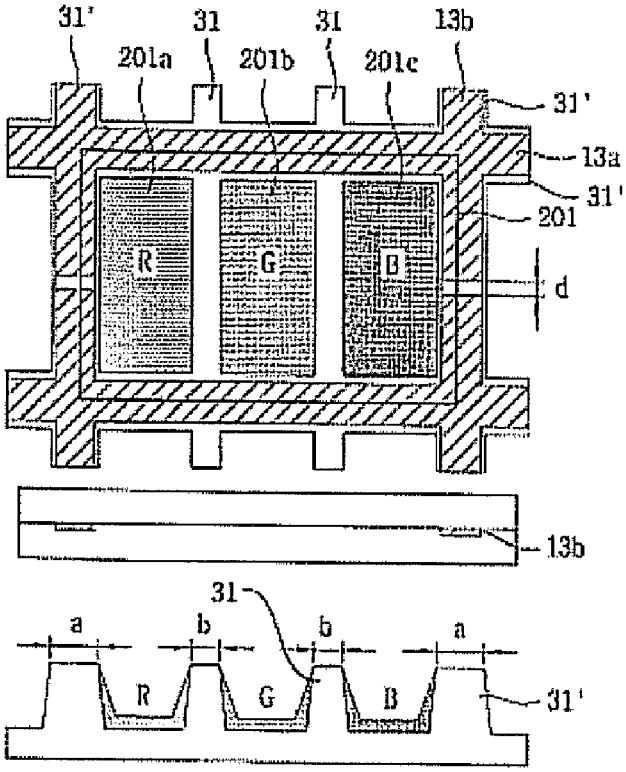

FIGS. 7A and 7B are views illustrating the black matrix structures of the discharge cell structures in the plasma display panel according to the present invention.

As shown in FIGS. 7A and 7B, the black matrixes 13*a* and 13*b* are almost the same as those of FIGS. 6A and 6B. However, the second black matrix 13*b* is formed in the extension direction of the second barrier rib 31' to have a predetermined gap (d) partitioning the unit pixel 201 at its center portion. In other words, the black matrix is short-circuited to secure electrical insulation. The barrier rib structure is the same as that of the first embodiment of the present invention.

In the inventive PDP having the barrier rib structure and the black matrix structure according to the second embodiment of the present invention, the color mixture caused by light emission of each unit pixel can be improved and concurrently, the reflectance against external light and internal transmitted light can be decreased, thereby improving the contrast characteristic.

Third Embodiment

Figure 8A:
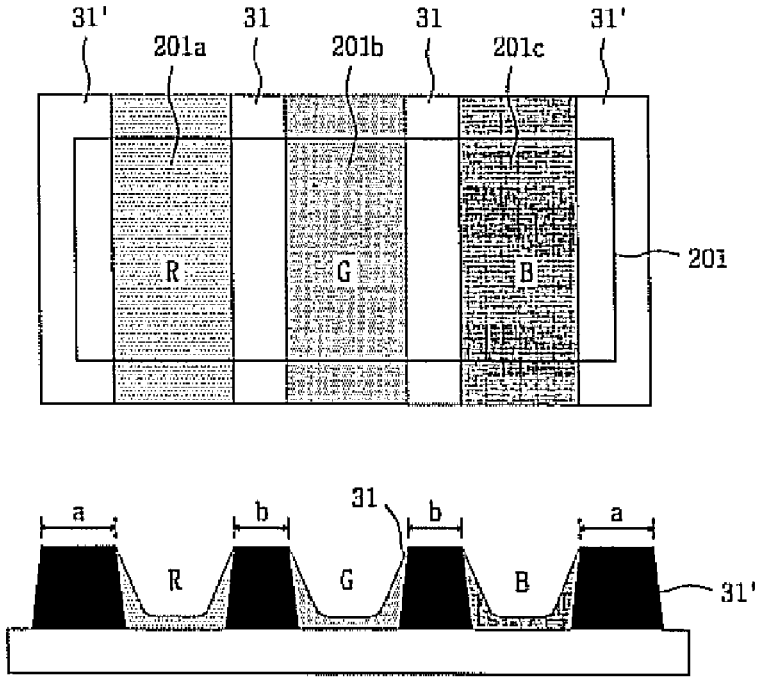
FIGS. 8A and 8B are views illustrating barrier rib structures of discharge cell structures in a plasma display panel according to a third embodiment of the present invention.
Figure 8B:
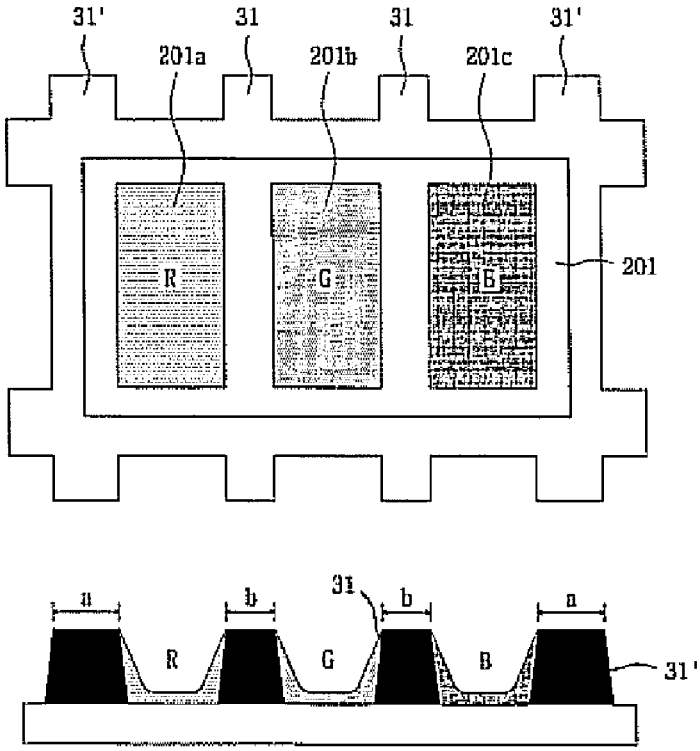

FIGS. 8A and 8B are views illustrating barrier rib structures of discharge cell structures in a plasma display panel according to a third embodiment of the present invention. In other words, FIG. 8A illustrates the barrier rib structure of a stripe-type discharge cell structure, and FIG. 5B illustrates the barrier rib structure of a well-type discharge cell structure.

In FIGS. 8A and 8B, the barrier rib structures are the same as those of the first embodiment of the present invention and therefore, their descriptions are omitted. However, the barrier rib structures are all formed of black-color material.

As such, in the inventive PDP having the barrier rib structure, color mixture caused by light emission of each unit pixel can be improved, and the barrier rib can be formed of black-color material, thereby decreasing reflectance against external light and improving a contrast characteristic.

FIGS. 9A through 9D are views sequentially illustrating a method for manufacturing the barrier rib in the plasma display panel according to an embodiment of the present invention.

Figure 9A:
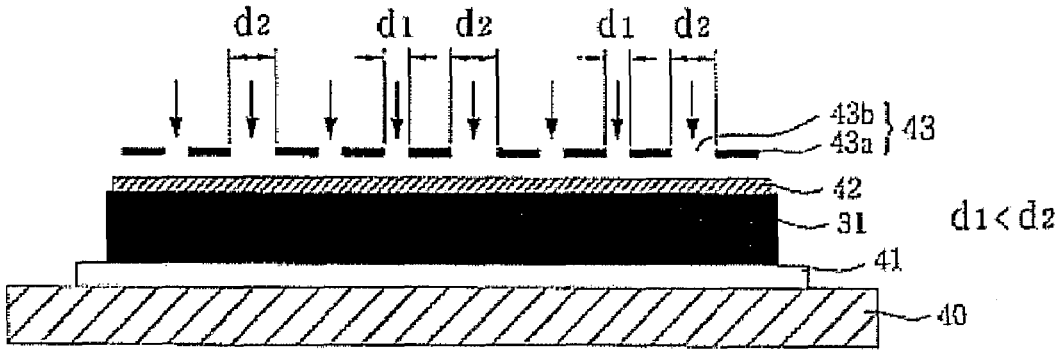
FIGS. 9A through 9D are views sequentially illustrating a method for manufacturing a barrier rib in a plasma display panel according to an embodiment of the present invention.

Referring to FIG. 9A, a dielectric material 41 is formed on a lower substrate 40 having an address electrode (not shown) mounted thereon. After that, a barrier rib paste 31 is formed at a predetermined thickness on the dielectric material 41. Next, the barrier rib paste 31 is formed of black-color material in a printing method or a coating method so as to reduce the reflectance against the external light. After that, a dry film resin (Hereinafter, referred to as "DFR") 42 is formed on the barrier rib paste 31 in a laminating process. Next, a photo mask 43 is aligned on the DFR 42, and light is irradiated on the photo mask 43. The photo mask 43 has a pattern of irregular intervals (d1 and d2) between a light blocking unit 43*a* and a light transmitting unit 43*b*. This is to differentiate the barrier ribs in width, that is, the barrier rib functioning as the boundary between the R, G, B sub-pixels and the barrier rib functioning as the boundary between the unit pixels constituted of the R, G, B sub-pixels.

Figure 9B:
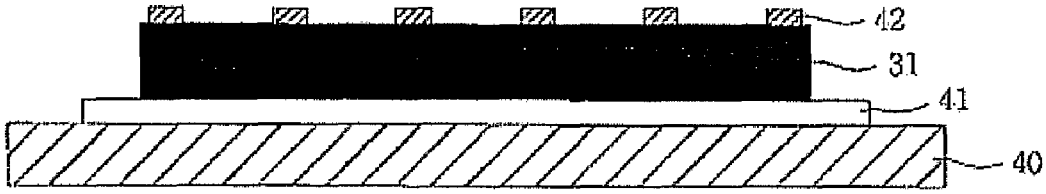

Referring to FIG. 9B, after the DFR 42 is exposed, a developing process is performed. In the developing process, a DFR 42 region not exposed to light (Hereinafter, referred to as "non-exposure region") remains on the barrier rib paste 31 to form a DFR 42 pattern, whereas a DFR 42 region exposed to light (Hereinafter, referred to as "exposure region") is etched out.

Figure 9C:
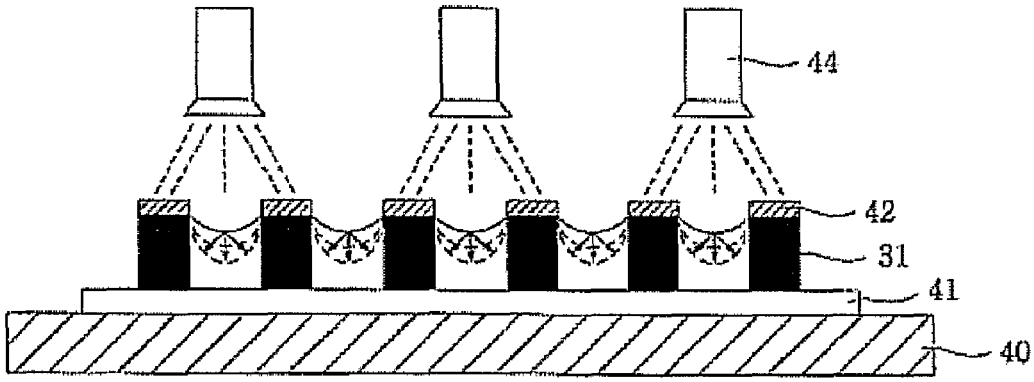

Referring to FIG. 9C, a sand blasting device 44 is placed and driven over the developed barrier rib paste 31 and the DFR 42 to spray sand particles onto the barrier rib paste 31. At this time, the barrier rib paste 31 is cut out due to sputtering of the sand particles whereas the barrier rib paste 31 corresponding to the barrier rib is protected by the DFR 42 pattern.

Figure 9D:
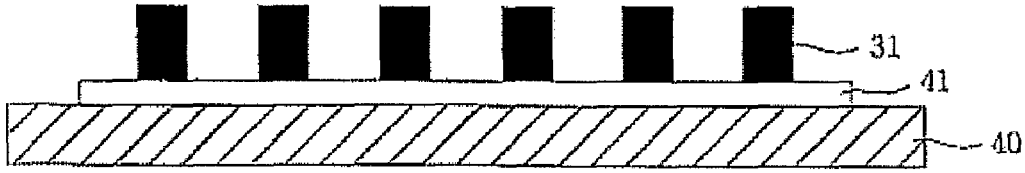

Referring to FIG. 9D, after the barrier rib paste 31 is protected and patterned by the DFT 42 in a sand blasting process, the DFR 42 is peeled off in a peeling-off process. Next, the barrier rib paste 31 is plasticized, thereby completing the barrier rib. As a result, a discharge space is concavely provided between the barrier ribs.

In the inventive barrier rib of the PDP manufactured through the above processes, when the PDP is driven, the visual color mixture of the discharge cell is improved and concurrently, the barrier rib paste is formed of the black-color material, thereby reducing the reflectance against the external light and improving the contrast characteristic.

FIGS. 10A through 10D are views sequentially illustrating a method for manufacturing a barrier rib in a plasma display panel according to another embodiment of the present invention.

Figure 10A:
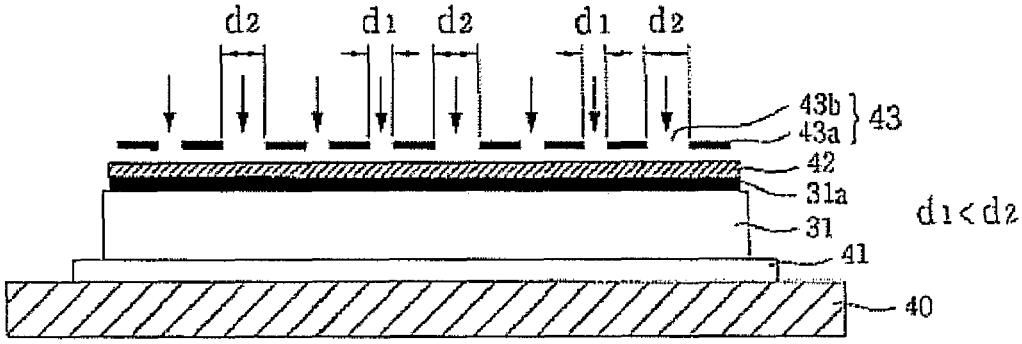
FIGS. 10A through 10D are views sequentially illustrating a method for manufacturing a barrier rib in a plasma display panel according to another embodiment of the present invention.

Referring to FIG. 10A, a dielectric material 41 is formed on a lower substrate 40 having an address electrode (not shown) mounted thereon, and then a white-color barrier rib paste 31 is formed at a predetermined thickness on the dielectric material 41. After that, a photosensitive black-color paste 31*a* is layered on the barrier rib paste 31 in a printing method or a coating method. After that, a dry film resin (DFR) 42 is formed on the photosensitive black-color paste in a laminating process. A photo mask 43 is aligned on the DFR 42 and then, light is irradiated on the photo mask 43. At this time, the photo mask has a pattern of irregular intervals (d1 and d2) between a light blocking unit 43*a* and a light transmitting unit 43*b*. This is to differentiate the barrier ribs in width, that is, the barrier rib functioning as the boundary between the R, G, B sub-pixels and the barrier rib functioning as the boundary between the unit pixels constituted of the R, G, B sub-pixels.

Figure 10B:
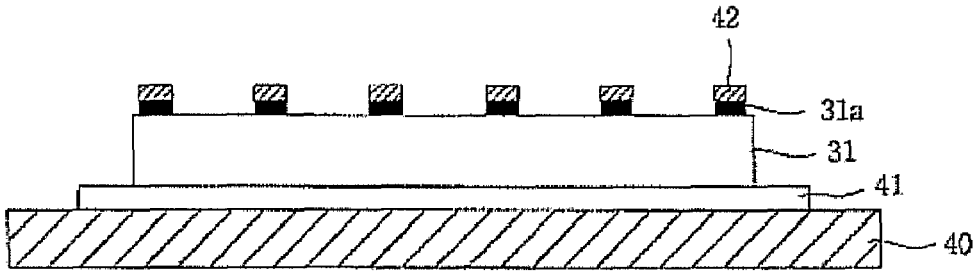

Referring to FIG. 10B, after the DFR 42 is exposed, a developing process is performed. In the developing process, a DFR 42 region not exposed to light (Hereinafter, referred to as "non-exposure region") remains on the photosensitive black-color paste 31*a* to form a DFR 42 pattern, whereas a DFR 42 region exposed to light (Hereinafter, referred to as "exposure region") is etched out.

Figure 10C:
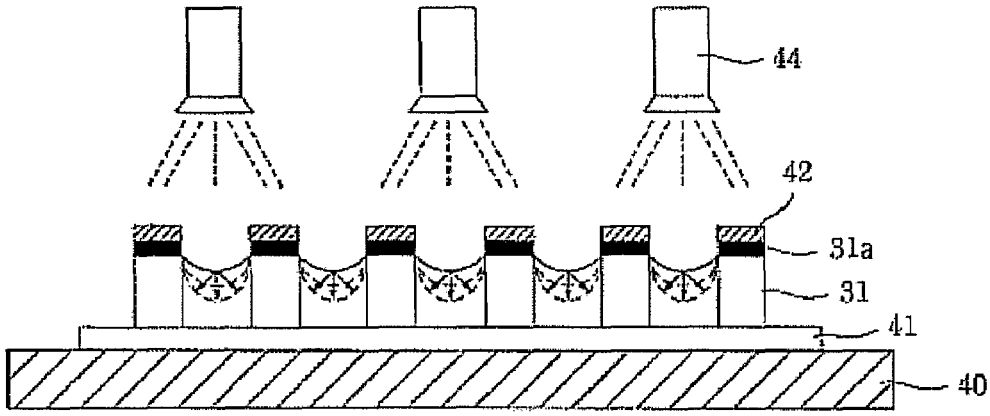

Referring to FIG. 10C, a sand blasting device 44 is placed and driven over the developed barrier rib paste 31, the photosensitive black-color paste 31*a* and the DFR 42 to spray sand particles onto the barrier rib paste 31. At this time, the barrier rib paste 31 is cut out due to sputtering of the sand particles whereas the barrier rib paste 31 corresponding to the barrier rib is protected by the DFR 42 pattern.

Figure 10D:
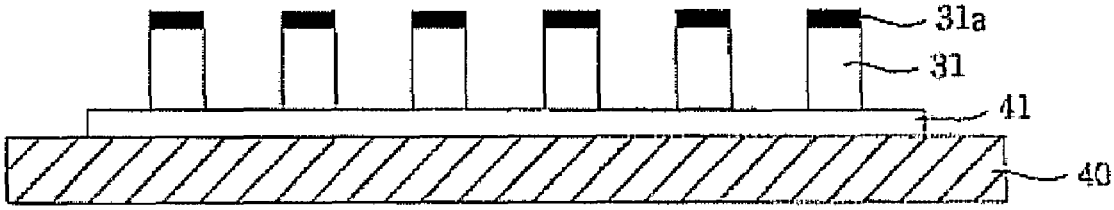

Referring to FIG. 10D, after the barrier rib paste 31 is protected and patterned by the DFT 42 in a sand blasting process, the DFR 42 is peeled off in a peeling-off process. Next, the barrier rib paste 31 is plasticized, thereby completing the barrier rib. As a result, a discharge space is concavely provided between the barrier ribs.

Fourth Embodiment

Figure 11:
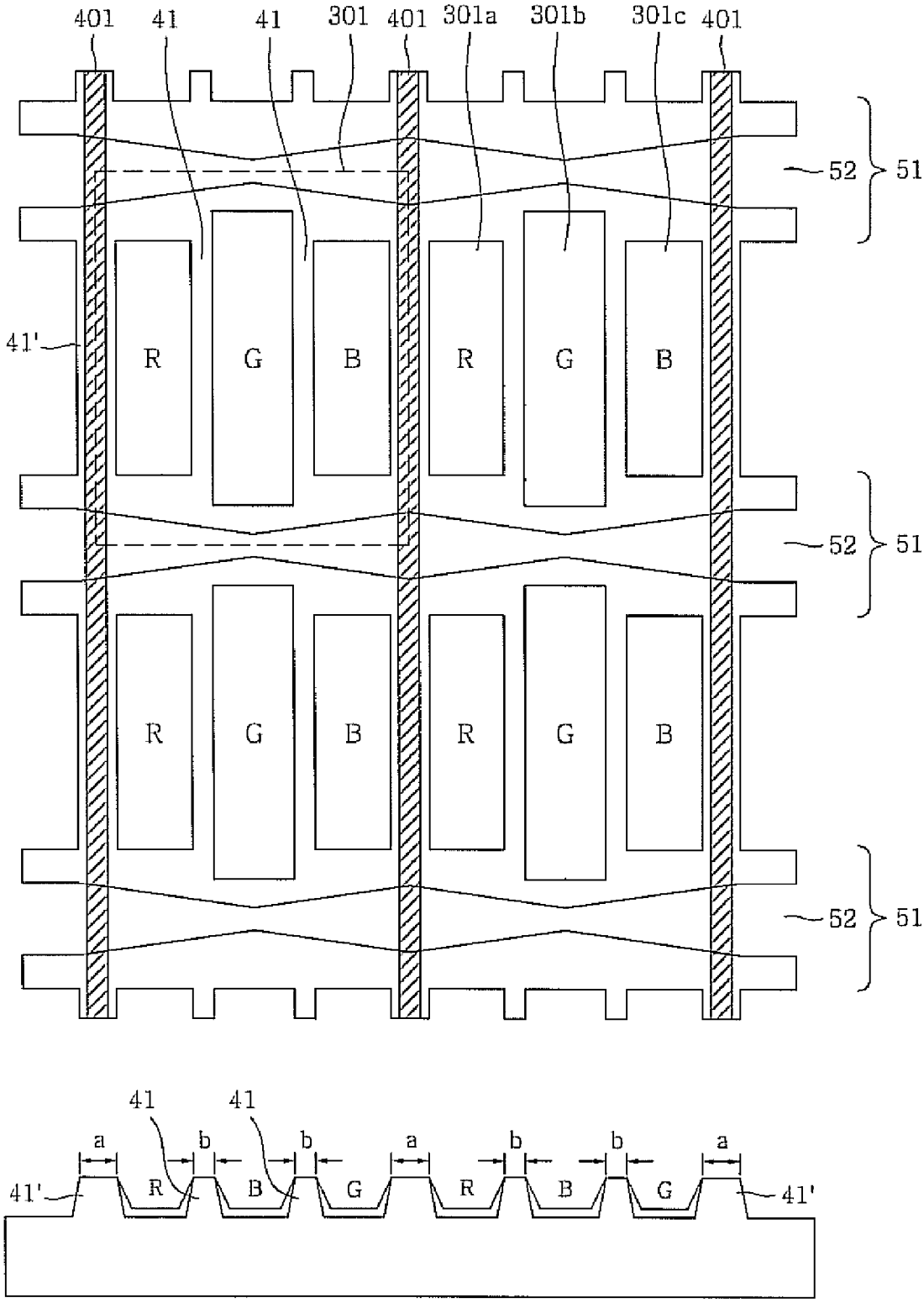
FIG. 11 is a view illustrating barrier rib structures of discharge cell structures in a plasma display panel according to a fourth embodiment of the present invention.

FIG. 11 is a view illustrating barrier rib structures of discharge cell structures in a plasma display panel according to a fourth embodiment of the present invention. In other words, FIG. 11 illustrates the barrier rib structure in a well-type discharge cell structure according to the present invention.

As shown in FIG. 11, the inventive plasma display panel comprises a plurality of unit pixels 301, a first barrier rib 41, a second barrier rib 41', and a longitudinal black matrix 401. The plurality of unit pixels 301 comprises a first sub-pixel 301*a*, a second sub-pixel 301*b*, and a third sub-pixel 301*c*. The first sub-pixel 301*a*, the second sub-pixel 301*b*, and the third sub-pixel 301*c* correspond to a red color sub-pixel R, a blue color sub-pixel B, and a green color sub-pixel G, respectively.

The first barrier rib 41 is formed to function as a boundary between the sub-pixels 301*a*, 301*b*, and 301*c* and is formed in a longitudinal direction of the sub-pixels 301*a*, 301*b*, and 301*c*.

The second barrier rib 41' is formed to function as a boundary between the plurality of unit pixels 301 and is formed in a longitudinal direction of the first barrier rib 41. The second barrier rib 41' has a width "a" that is more than a width "b" of the first barrier rib 41. The longitudinal black matrix 401 is formed over the second barrier rib 41'.

The first barrier rib 41 and the second barrier rib 41' may be disposed at a rear substrate. The first barrier rib 41 partitions red (R), blue (B) and green (G) sub-pixels 301*a*, 301*b* and 301*c*. The second barrier rib 41' partitions a unit pixel 301 and an adjacent unit pixel. On the assumption that the first barrier rib 41 partitioning the R, B, G sub-pixels 301*a*, 301*b* and 301*c* has a width of "b" and the second barrier rib 41' partitioning the unit pixels 301 and the adjacent unit pixel has a width of "a", the width "a" is more than the width "b". In other words, the width "a" of the second barrier rib 41' functioning as a boundary between the unit pixel and the adjacent unit pixel is greater than the width "b" of the first barrier rib 41 functioning as a boundary between the sub-pixels 301*a*, 301*b*, and 301*c*. A black-color material layer is formed on the first barrier rib 41 and the second barrier rib 41'.

The inventive plasma display panel further comprises a lateral barrier rib 51. The lateral barrier rib 51 is formed in a vertical direction of the first barrier rib 41 and the second barrier rib 41'. In other words, the lateral barrier rib 51 is perpendicular to the first barrier rib 41 and the second barrier rib 41'

The lateral barrier rib 51 comprises a channel 52. Gases are emitted through the channel 52. A width of the longitudinal black matrix 401 is less than a width "a" of the second barrier rib 41'. The width "a" of the second barrier rib 41' equals 170 μm. The width of the longitudinal black matrix 401 equals 90 μm. Thus a difference between the width of the longitudinal black matrix 401 and the width "a" of the second barrier rib 41' ranges from 10 μm to 200 μm. Preferably, the difference between the width of the longitudinal black matrix 401 and the width "a" of the second barrier rib 41' ranges from 40 μm to 80 μm. The longitudinal black matrix 401 may be formed at a front substrate.

A difference between the width "b" of the first barrier rib 41 and the width "a" of the second barrier rib 41' ranges from 30 μm to 300 μm.

areas of the red color sub-pixel 301*a*, the green color sub-pixel 301*c*, and the blue color sub-pixel 301*b* may be different from one another. Preferably, the area of the blue color sub-pixel 301*b* is the largest. Thus white balance can be easily adjusted.

The inventive plasma display panel further comprises a lateral barrier rib 51 of a width determined by the area of the sub-pixels 301*a*, 301*b*, and 301*c*.

A channel 52 is formed on the lateral barrier rib 51. A width of the channel remains constant or varies for each of the sub-pixels 301*a*, 301*b*, and 301*c*.

The inventive barrier rib can be manufactured by using not only a sand blasting method but also any one of a screen printing method, an additive method and a photosensitive paste method. The inventive barrier rib is applicable not only to the well-type discharge cell structures of FIG. 11, but also to a stripe-type, a delta-type or honey-type discharge cell structure.

As such, in the inventive plasma display panel having the barrier rib structure, a unit pixel color combined due to light emission of the R, G, B sub-pixels is more spaced apart from an adjacent unit pixel color, thereby improving a visual color mixture.

In the inventive barrier rib of the PDP manufactured through the above processes, the luminance characteristic is not only improved, but also the contrast characteristic is improved.

As described above, the present invention has an effect in that the color mixture caused by the light emission of each unit discharge cell is improved in the PDP, and the reflectance against the external light and the internal light is reduced, thereby improving the contrast characteristic.

Other implementations are within the scope of the following claims.

What is claimed is:

1. A plasma display panel for displaying an image, the panel comprising:

a plurality of unit pixels comprising a first sub-pixel, a second sub-pixel, and a third sub-pixel, wherein the first sub-pixel corresponds to a red color sub-pixel, the second sub-pixel corresponds to a green color sub-pixel, and the third sub-pixel corresponds to a blue color sub-pixel;

a first barrier rib formed to function as a boundary between the first, second and third sub-pixels and formed in a longitudinal direction of the first, second and third sub-pixels;

a second barrier rib formed to function as a boundary between the plurality of unit pixels and formed in a longitudinal direction of the first, second and third sub pixels, wherein the second barrier rib has a width that is more than a width of the first barrier rib;

a longitudinal black matrix formed over the second barrier rib; and a lateral barrier rib comprising a channel and formed in a vertical direction of the first barrier rib and the second barrier rib.

2. The panel of claim 1, wherein a width of the longitudinal black matrix is less than a width of the second barrier rib.

3. The panel of claim 1, wherein a width of the second barrier rib equals 170 μm.

4. The panel of claim 1, wherein a width of the longitudinal black matrix equals 90 μm.

5. The panel of claim 2, wherein a difference between a width of the longitudinal black matrix and a width of the second barrier rib ranges from 10 μm to 200 μm.

6. The panel of claim 5, wherein the difference ranges from 40 μm to 80 μm.

7. The panel of claim 1, wherein the longitudinal black matrix is formed at a front substrate.

8. The panel of claim 1, wherein a difference between a width of the first barrier rib and a width of the second barrier rib ranges from 30 μm to 300 μm.

9. The panel of claim 1, wherein areas of the red color sub-pixel, the green color sub-pixel, and the blue color sub-pixel are different from one another.

10. The panel of claim 9, wherein an area of the blue color sub-pixel is the largest.

11. The panel of claim 10 further comprising:

a lateral barrier rib of a width determined by the area of the sub-pixels.

12. The panel of claim 11, wherein a channel is formed on the lateral barrier rib.

13. The panel of claim 12, wherein a width of the channel remains constant for each of the sub-pixels.

14. The panel of claim 12, wherein a width of the channel varies for each of the sub-pixels.

* * * * *